US005451965A

United States Patent [19]

Matsumoto

[11] Patent Number: 5,451,965

[45] Date of Patent: Sep. 19, 1995

[54] FLEXIBLE ANTENNA FOR A PERSONAL COMMUNICATIONS DEVICE

[75] Inventor: Wataru Matsumoto, Gunma, Japan

[73] Assignee: Mitsubishi Denki Kabushiki Kaisha, Tokyo, Japan

[21] Appl. No.: 88,792

[22] Filed: Jul. 8, 1993

[30] Foreign Application Priority Data

Jul. 28, 1992 [JP] Japan ..... 4-201292
Feb. 3, 1993 [JP] Japan ..... 5-016173

[51] Int. Cl.[6] ..... H01Q 1/24

[52] U.S. Cl. ..... 343/702; 343/741; 343/866

[58] Field of Search ..... 343/702, 741, 742, 866, 343/867; H01Q 1/24

[56] References Cited

U.S. PATENT DOCUMENTS

| | | | |
|---|---|---|---|
| 2,292,163 | 8/1942 | Shea | 343/702 |
| 2,313,231 | 3/1943 | Forbes | 343/702 |
| 4,471,493 | 9/1984 | Schober | 343/702 |
| 4,543,581 | 9/1985 | Nemet | 343/702 |
| 4,894,663 | 1/1990 | Urbish et al. | 343/702 |
| 4,992,799 | 2/1991 | Garay | 343/702 |
| 5,138,328 | 8/1992 | Zibrik et al. | 343/702 |
| 5,170,173 | 12/1992 | Krenz et al. | 343/702 |
| 5,258,892 | 11/1993 | Stanton et al. | 343/702 |
| 5,337,061 | 8/1994 | Pye et al | 343/702 |

*Primary Examiner*—Donald Hajec
*Assistant Examiner*—Hoanganh Le
*Attorney, Agent, or Firm*—Wolf, Greenfield & Sacks

[57] ABSTRACT

An antenna for a portable radiotelephone which is configured in consideration of the nature of the electromagnetic wave and of the antenna-user relation in order to improve antenna performance in terms of received gain and directivity. Specifically, this is a multi-directional antenna configuration, including two or more planes of antenna oriented in different directions, for receiving electromagnetic waves in various angles or directions. The invention deals with at least two different cases in order to achieve satisfactory reception by a portable radiotelephone: when an antenna is relatively close to the user or a virtual ground, it should be provided normal to the user, and on the other hand, at another angle or parallel to the user when relatively far from the user or virtual ground.

3 Claims, 9 Drawing Sheets

FLEXIBLE ANTENNA FOR A PERSONAL COMMUNICATIONS DEVICE

BACKGROUND OF THE INVENTION

1. Field of the Invention

The present invention relates to antennas for portable radiotelephones. The invention is more specifically directed to antenna configurations which are disposed within the housing of the hand-held communications equipment.

2. Description of the Related Art

With the recent development of downsizing technologies radiotelephones have become more and more compact in size. Consequently there is a need for highly sensitive antennas for such small-sized radiotelephones. In this respect, loop-oriented antennas have generally been popular.

FIG. 9 illustrates a general view of a conventional loop-oriented antenna configuration for a portable radiotelephone. The electronic and magnetic fields of a plane wave produced in connection with the loop antenna also are shown. The conventional loop-oriented antenna configuration in the figure includes a loop antenna 1, a matching capacitor 2, a feed line 3 (a feeder), a ground 4, a receive signal 5, a printed circuit board 6 carrying circuitry, a housing 7 of the radiotelephone and feeding points 8. The vertically polarized electric-field wave 21 and the horizontally polarized magnetic-field wave 22 are shown in an orthogonal coordinate systems, in relation to the loop antenna.

A radiotelephone with the conventional loop-oriented antenna configuration shown in FIG. 9 generally receives desirable radio wave, mainly magnetic-field wave, in the following way. The loop antenna 1 detects magnetic-field components in an electromagnetic wave through impedance matching by the matching capacitor 2 at the feeding points 8. Reception or received gain becomes the highest when the impedance of the antenna and an input impedance of the receiving circuit match. Tuning frequency is automatically fixed on the basis of the shape of the antenna and the impedance of matching capacitor.

With the form and location given in FIG. 9, the loop antenna 1 primarily receives a vertically polarized electric-field wave 21, which is oriented in the X-Z plane. In other words, the loop antenna 1 in that condition looses gain for the horizontally polarized magnetic-field wave 22, which is oriented in the Y-Z plane, due to inefficient reception.

The size of an antenna generally affects the received gain or sensitivity of antenna. A small-sized radiotelephone usually contains one or more small-sized antenna(s), which naturally results in poor antenna performance. Generally a conventional loop-oriented antenna configuration has only one loop antenna as illustrated in FIG. 9 and receives only one kind of polarized electromagnetic wave depending upon the location or direction of the antenna. These are some problems that the conventional art has confronted.

There are some loop-oriented antenna configurations for small-sized portable radiotelephones that have been proposed as a solution to the foregoing problems. One example (Japanese Unexamined Patent Publication No. 172804/1984) has two partial-loop antennas of different size joined vertically together to form an apparent solid loop. This example, however, fall to provide one of the essential requirements for an antenna that is used with hand-held communications equipment, namely, an antenna-user relation. In other words, this example does not consider the nature of the electromagnetic wave in relation to the distance and direction of the antenna with respect to the user. For this reason, the multi-directional antenna of this example cannot provide a satisfactory result due to the configuration having the two partial-loop antennas provided within the same housing. Specifically, one of the partial-loop antennas becomes very inefficient when the radiotelephone is very close to the user in a telephone operating position. This example, accordingly, falls to provide an efficient antenna performance.

Another example (Japanese Unexamined Patent Publication No. 141730/1991) provides an active antenna-user relation. The loop antenna of this example is dependent upon the user. Specifically, a human body or a virtual ground is used as a tool for switching the antenna from/to tuning state or to/from an untuning state. This method improves the directivity of antenna only in an untuning state, with a human body utilized as an antenna. The disclosure still fails to provide an antenna that is oriented vertically to the user in the telephone operating position in order to permit reception of horizontally polarized radio waves by the antenna. Such capability is essential to acquiring an efficient receiving gain when an antenna is close to the user.

As described hereinbefore, the conventional art still contains some problems in terms of the directivity and received gain of loop-oriented antenna configurations. As the size of the portable radiotelephone becomes smaller, the inner loop antenna that is housed within the side of the portable radiotelephone also must become smaller. The smaller antenna necessarily has a lower received gain. Thus, there is a need to acquire a highly efficient antenna performance with small-sized antennas. Another challenge is to provide a proper balance between the two received polarized electromagnetic waves, the vertical wave and the horizontal wave. Further, it is another object to solve the problem caused by an inevitable nature of hand-held communications equipment, namely, that a telephone is usually in a user's hand, which acts as a conductor to interrupt the reception of radio waves.

SUMMARY OF THE INVENTION

The present invention is designed to solve the foregoing problems. It is a primary object of the present invention to provide an improved loop-oriented antenna configuration for portable radiotelephones which provides a highly efficient antenna performance in terms of high received gain of the polarized electromagnetic wave by broadening the directivity of an inner antenna within a portable radiotelephone. It is another object of the present invention to provide an improved loop-oriented antenna configuration for portable radiotelephones by reducing the potential loss of received gain caused by the antenna-user relation.

According to the present Invention, there is an antenna set to a virtual ground plane, comprising:

(A) first partial antenna whose directivity crosses the virtual ground, (B) a second partial antenna whose directivity is different from that of the first partial antenna; and, (C) a conductor for connecting each of the first and second partial antennas.

Further in accordance with the present invention, there is a loop antenna set to a virtual ground plane, comprising:

(A) first partial-loop antenna having plural ends, whose loop direction crosses the virtual ground plane;

(B) a second partial-loop antenna having plural ends, whose loop direction is different from that of the first partial loop antenna; and, (C) conductors for connecting the two ends of the first and second partial-loop antenna.

Further in accordance with the present invention, such loop antenna, further comprises a microphone for sending signals which are set at a center of axial symmetry of the first or second partial-loop antenna.

Further in accordance with the present invention, such loop antenna, further comprises a matching capacitor that is set at the center of axial symmetry of the first or second partial-loop antenna.

Further in accordance with the present invention, the directivity of the first partial-loop antenna crosses the body of an operator as virtual ground plane at range of angles between 60 degrees and 120 degrees with the body.

Further in accordance with the present invention, there is a method for using an antenna set to a virtual ground, including a first partial-loop antenna and a second partial-loop antenna in a lid, the method comprising the steps of;

(A) opening the lid which contains the second partial-loop antenna, and;

(B) forming an angle of the first partial-loop antenna with the virtual ground between 60 degrees and 120 degrees.

BRIEF DESCRIPTION OF THE DRAWINGS

FIG. 3(*b*) is a graph of received gain versus wavelength-oriented distance "h" In FIG. 3(*a*).

FIG. 8(*b*) is a graph of received power versus the positioning angle "$\phi$".

DESCRIPTION OF THE PREFERRED EMBODIMENTS

Figure 1A:
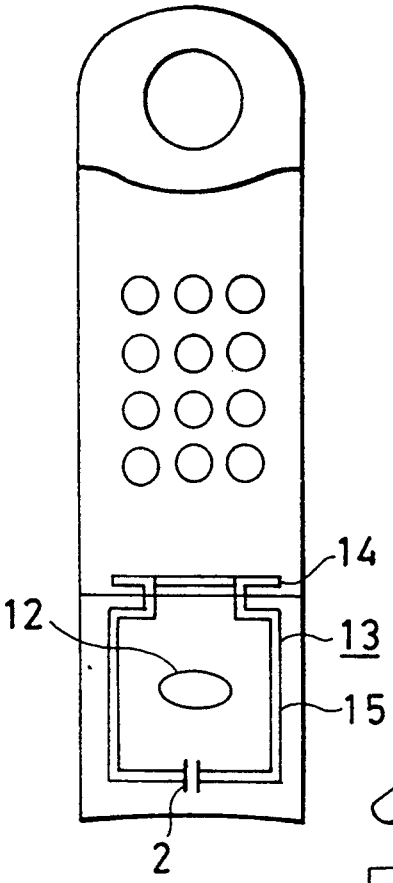
FIGS. 1(*a*), 1(*b*), and 1(*c*) show front, side and top views, respectively, of a portable radiotelephone illustrating an antenna configuration according to one embodiment of the present invention.
Figure 1B:
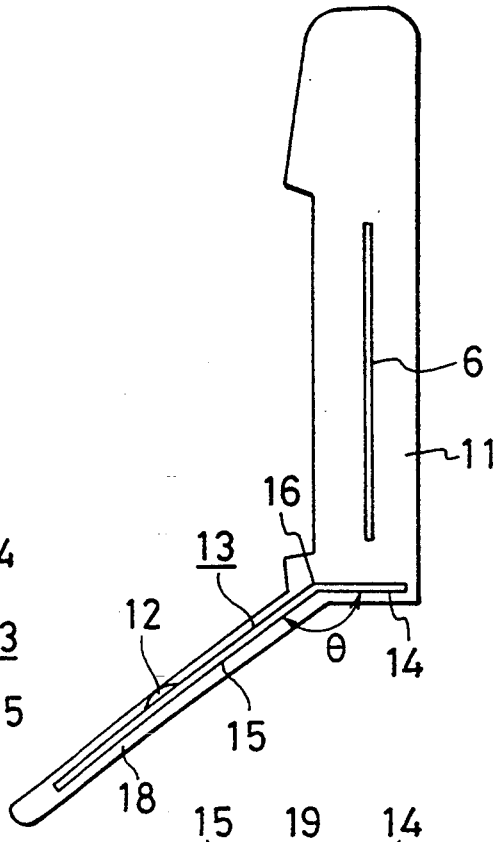
Figure 1C:
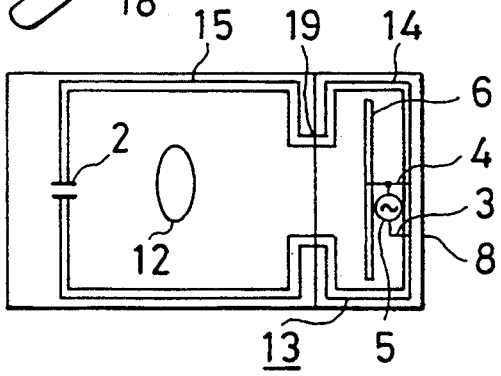
Figure 9:
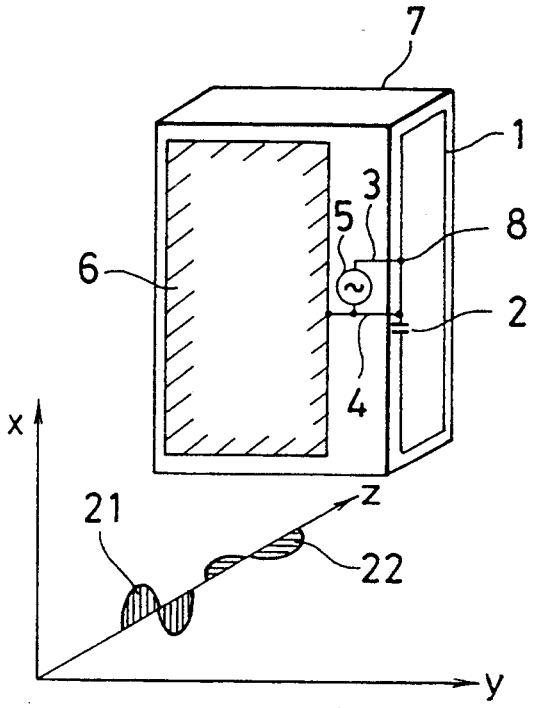
FIG. 9 PRIOR ART
FIG. 9 shows a general view of conventional portable radiotelephone illustrating a loop-oriented antenna configuration and an explanatory drawing of polarized electromagnetic wave in relation to the loop antenna configuration shown in the general view.

FIGS. 1(*a*), 1(*b*), and 1(*c*) show front, side and top views, respectively, of a portable radiotelephone illustrating an antenna configuration according to one embodiment of the present invention. A portable radiotelephone In the figure has a main housing 11, a microphone 12, a loop antenna 13 (including first and second partial-loop antennas 14 and 15), and a fulcrum or joint 16 for folding up and putting a lid 18 on a surface of the main housing 11. Other numerals in the figure are equivalent to those of the conventional art discussed earlier in FIG. 9 and will not be mentioned here. The lid 18 contains the microphone 12 and the second partial-loop antenna 15. The microphone 12 in this embodiment is located approximately at the center of the circle of the second partial-loop antenna 15, which may make the portable radiotelephone more convenient for operation and minimize possible disturbances of electromagnetic waves caused by using the microphone 12. In this embodiment a matching capacitor 2 Is provided at one end of the axis of symmetry of the second partial-loop antenna 15 with a feeding point 8 at the other. It may be ideal to employ only one matching capacitor as shown in the figure in view of the potential receiving losses caused by providing additional elements.

The first partial-loop antenna 14 is set at an angle where it receives horizontally polarized radio waves when a portable radiotelephone is held in the upright position, i.e., In a typical telephone operating position. The second partial-loop antenna 15 or the lid 18 is set at an angle where it receives vertically polarized radio waves with respect to the first partial-loop antenna 14, when the lid 18 is fully open or in the telephone operating position. The first partial-loop antenna 14 forms a smaller partial-loop within the bottom plane of the main housing 11 of a portable radiotelephone, while the second partial-loop antenna 15 forms a partial-loop larger than the first partial-loop, within the lid 18. The two partial-loop antennas are joined together at the Fulcrum 16 by conductors 19 to form an apparent solid loop. The "$\theta$" in the figure indicates an angle which the bottom plane of the main housing, or the first partial-loop antenna 14, should make with the plane of the lid 18 or the second partial-loop antenna 15 when in an open position.

Figure 2A:
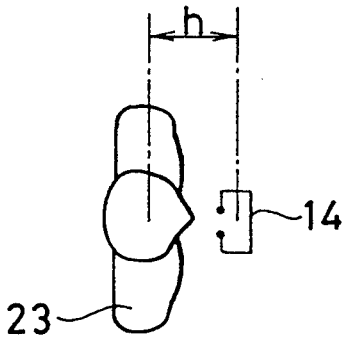
FIGS. 2(*a*) and 2(*b*) illustrate a relation between the first partial-loop antenna 14 of a portable radiotelephone in FIG. 1 and a user 23 concerning the telephone operating position and distance "h".
Figure 2B:
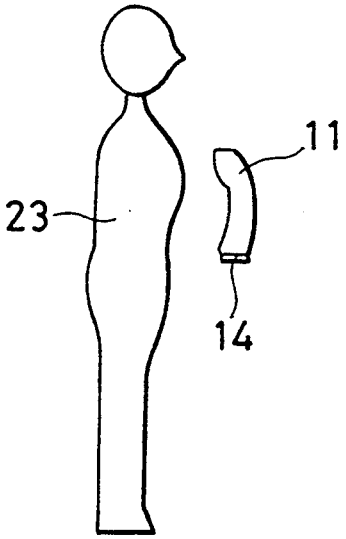

FIGS. 2(*a*) and 2(*b*) illustrate a relation between the first partial-loop antenna 14 of the portable radiotelephone in FIG. 1 and a user 23 concerning the telephone operating position and a distance "h". The directivity of the first partial-loop antenna 14 crosses the body of the user 23 as a virtual ground plane approximately vertically to the user when the user holds a portable radiotelephone in the upright position as shown in the figures. Then the first partial-loop antenna 14 receives vertically polarized radio wave to the user 23 or horizontally to the first partial-loop antenna 14.

Figure 3A:
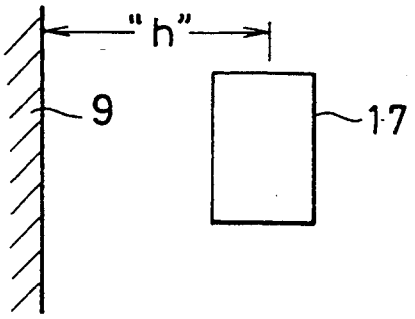
FIG. 3(*a*) is an explanatory view illustrating the distance "h" from the axis of symmetry of a general loop antenna 17 to a ground plane 9.
Figure 3B:
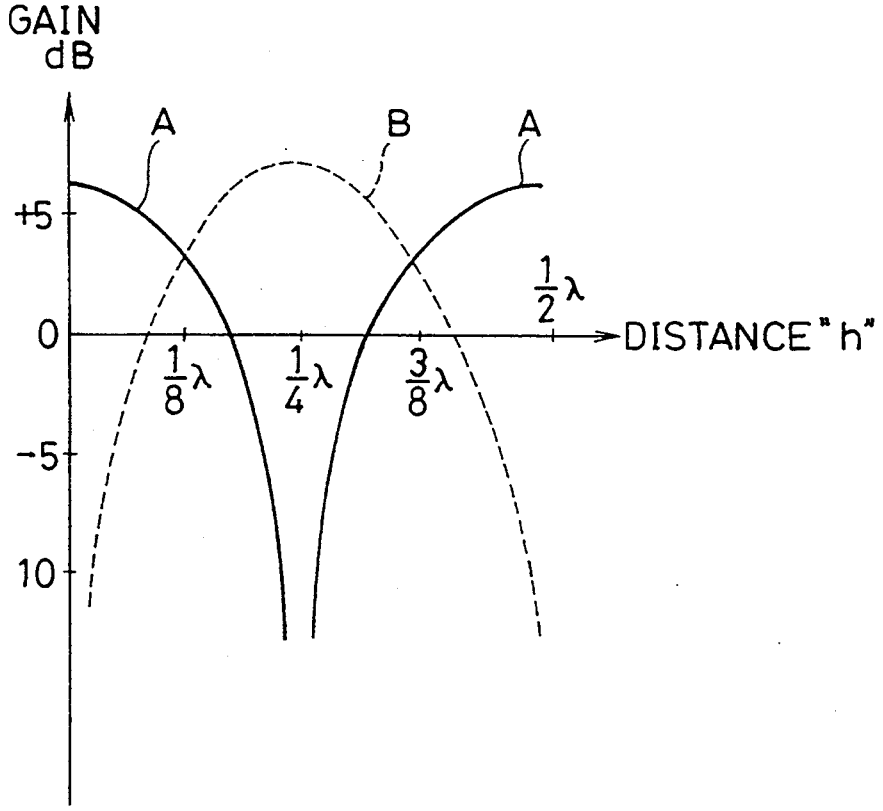

FIG. 3(*a*) is an explanatory view illustrating the distance "h" from the axis of symmetry of a general loop antenna 17 to a ground plane 9. FIG. 3(*b*) is a graph of received gain versus wavelength-oriented distance "h" in FIG. 3(*a*).

In FIG. 3(*b*), the solid line "A" is the curve of received gain of the general loop antenna 17 set vertically to the ground 9. The curves show that the gain reaches the peak when the distance "h" is zero or $\frac{1}{2}\lambda$. The broken line "B" is the curve of received gain of the loop antenna 17 set horizontally to the ground 9. The curve shows that the gain reaches the peak when the distance "h" is $\frac{1}{4}\lambda$.

Figure 4:
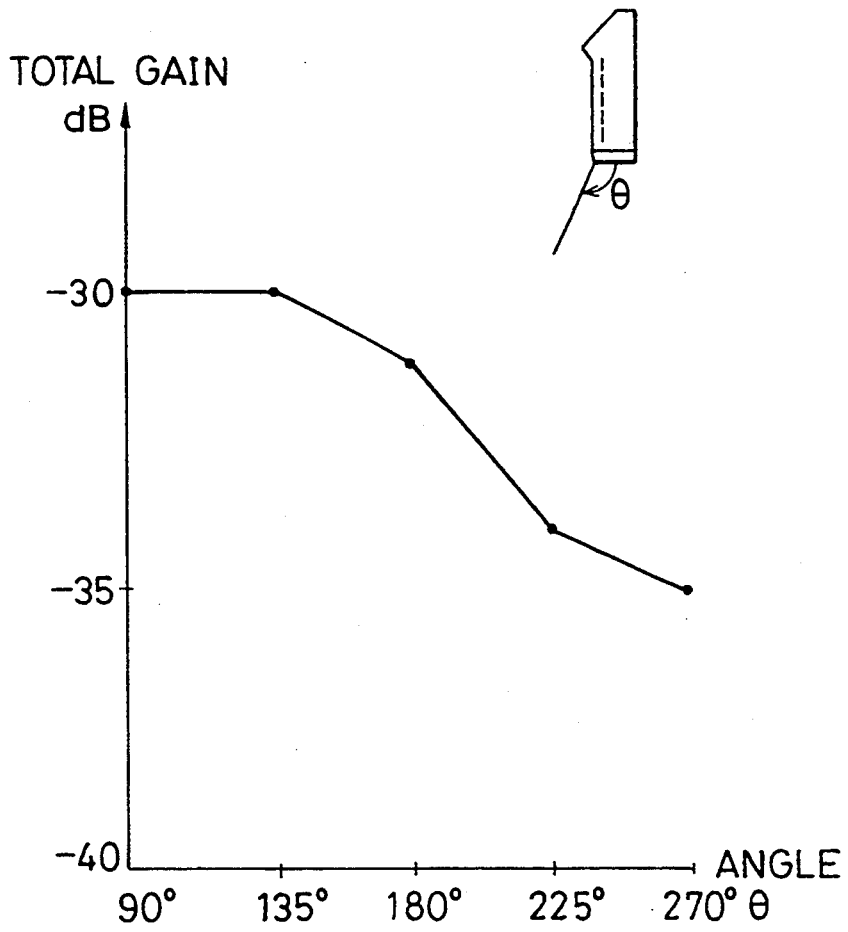
FIG. 4 is a graph of received gain of the loop antenna 13 versus "$\theta$", an angle which each plane of partial-loop antennas 14 and 15 makes with each other.

FIG. 4 is a graph of received gain of the loop antenna 13 versus "$\theta$", an angle which each plane of partial-loop antennas 14 and 15 forms with each other. In the present embodiment, a portable radiotelephone has the first partial-loop antenna 14 provided within the bottom plane of the main housing 11. The second partial-loop antenna 15, which is four times as large as the first partial-antenna 14, is provided within the lid 18. An equivalent conductor or a printed circuit board is illustrated in front of the main housing 11. The plane of the first partial-loop antenna 14 makes an angle "$\theta$" of the plane with the second partial-loop antenna 15.

In the graph, "$\theta$" ranges from 270 to 90 degrees depending upon the open angle of the lid 18. At an angle of 270 degrees, the lid 18 has been put on the face of the main housing 11 and overlap the equivalent conductor in front of the main housing 11. At an angle of 90 degrees, the lid 18 is fully open. According to the graph, the loop antenna 13 will have a lower gain as "$\theta$" comes closer to 270 degrees because the built-in second partial-loop antenna 15 within the lid 18 can be affected by the equivalent conductor and looses gain. The polygonal line in the graph shows that the loop antenna 13 can have a relatively high feasible gain when "$\theta$" is between 90 and 180 degrees. It also shows that it is preferable if "$\theta$" is between 90 and 135 degrees, where the received gain is high and stable.

A summary is now made of the present embodiment of the invention concerning antenna performance based on the foregoing discussions with reference to FIGS. 1 through 4.

The present invention is based on the notion that a human body is an approximate infinite conductor or a virtual ground in consideration of the following facts: (a) it is a well-known concept that a human body has a relatively high permitivity; and, (b) the present invention is applicable to a portable radiotelephone that is considerably smaller than a human body or the user 23 in size.

There are two ways of using a portable radiotelephone: (1) for a passive use for receiving radio waves when it is used only for receiving a call, and (2) for an active use for radiation when it is actually operated for communication or when the user speaks into the microphone 12.

In the former case, the lid 18 of a portable radiotelephone has been put on the main housing 11 and met the equivalent conductor in front of the main housing at an angle of 270 degrees. The function of the second partial-loop antenna 15, therefore, is virtually dead or inefficient due to a jamming effect by the equivalent conductor. In other words, received gain of the loop antenna 13 depends only upon that of the first partial-loop antenna 14 as shown in the "A" curves in FIG. 3(*b*). In practice, for example, a portable radiotelephone may be put in an pocket of the user for such passive use. In other words, the first partial-loop antenna 14 is very close and vertical to the user. Accordingly the loop antenna 13 acquires the highest received gain.

In the second case, the lid 18 of a portable radiotelephone is open at an angle ranging from 90 to 270 degrees. In this case both partial-loop antennas 14 and 15 are effective. The received gain of the loop antenna 13 is, therefore, affected by the two curves in FIG. 3(*b*), "A" and "B". Although "$\theta$" is affected by architectural factors of a portable radiotelephone to some extent, it has a rather generous range of feasible angles from 90 to 180 degrees, with preferable angles from 90 to 135 degrees, in terms of higher received gain according to FIG. 4.

As described above, a distinctive feature of the loop-oriented antenna for a portable radiotelephone in accordance with the present invention lies in the antenna configuration. Specifically, the loop antenna is made from the combination of two partial-loop antennas. One partial-loop antenna is provided vertically to the user or a virtual ground for receiving horizontally polarized radio waves with respect to the first partial-loop antenna and the other partial-loop antenna is provided at another angle or horizontally to the user for receiving vertically polarized radio waves with respect to the first partial-loop antenna in the telephone operating position. This arrangement contributes to highly efficient antenna performance in terms of received gain. In other words, one of the advantageous features of this embodiment lies in the multi-directional antenna configuration: the first partial-loop antenna receives horizontally polarized radio waves to itself when it is very close to the user or a virtual ground, and the second partial-loop antenna receives vertically polarized waves to the first partial-loop antenna when it is not very close to the user.

Thus the multi-directional antenna configuration cooperatively achieves a satisfactory result of receiving electromagnetic waves in every angle or in every possible telephone operating position in consideration of the antenna-user relation. The present invention therefore contributes to highly efficient antenna performance in terms of the improvement of received gain and directivity.

Figure 5A:
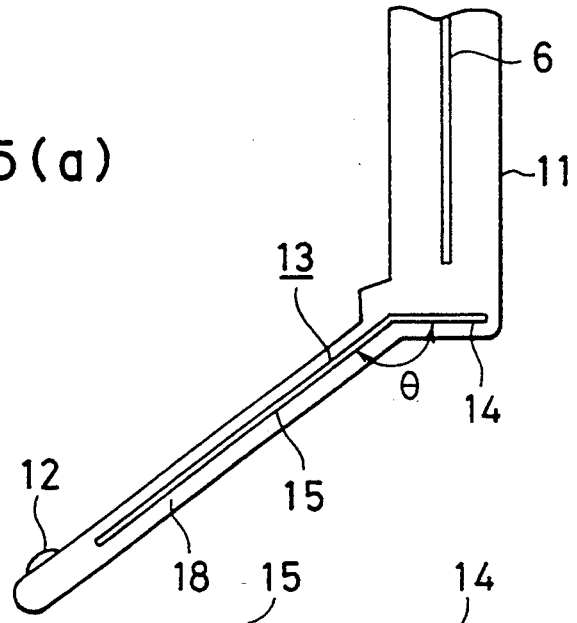
FIGS. 5(*a*) and 5(*b*) show a partially sectional side view and a top view respectively of a portable radiotelephone illustrating an antenna configuration according to another embodiment of the present invention in terms of the location of the microphone 12.
Figure 5B:
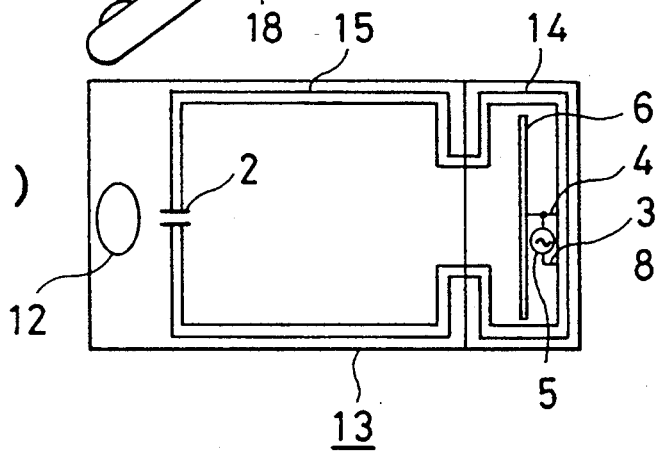

FIGS. 5(*a*) and 5(*b*) show a partially sectional side view and a top view, respectively, of a portable radiotelephone illustrating an antenna configuration according to another embodiment of the present invention concerning the location of the microphone 12. The present embodiment provides the microphone 12 outside the circle of the second partial-loop antenna 15. This orientation is different from the one in FIG. 1 provided in the circle. This also minimizes possible disturbances of electromagnetic waves that may be caused by using the microphone 12. The location of the microphone 12 can vary as long as it is on the axis of symmetry of the second partial-loop antennas 15 in terms of efficient antenna performance.

Figure 6A:
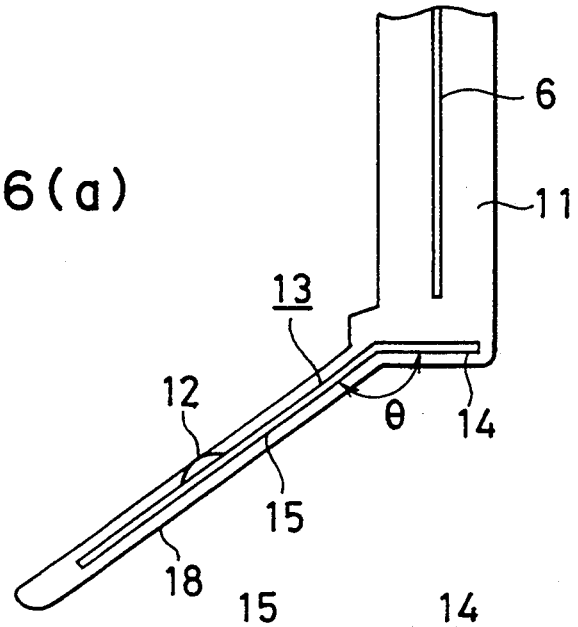
FIGS. 6(*a*) and 6(*b*) show a partially sectional side view and a top view respectively of a portable radiotelephone illustrating an antenna configuration according to another embodiment of the present invention.
Figure 6B:
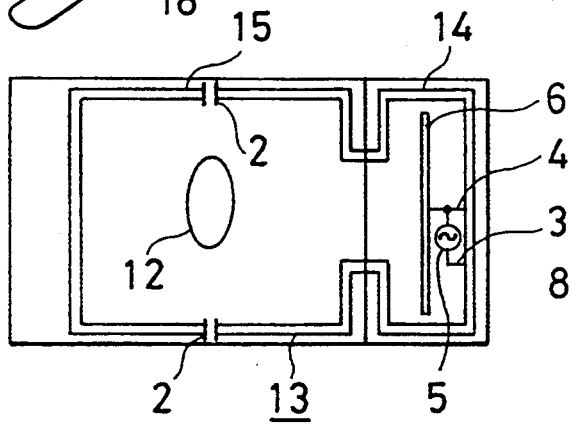

FIGS. 6(*a*) and 6(*b*) show a partially sectional side view and a top view, respectively, of a portable radiotelephone illustrating an antenna configuration according to another embodiment of the present invention concerning the location of the matching capacitors 2. The present embodiment provides two matching capacitors symmetrically with respect to the axis of symmetry of the second partial-loop antenna 15. This contributes to highly efficient antenna performance by matching even small imbalances of impedance on each side of the second partial-loop antenna 15 by each matching capacitor.

A "symmetrical" configuration of partner matching capacitors with respect to the axis of symmetry of the second partial-loop antenna 15 is significant in order to receive well-balanced magnetic-field radio wave by eliminating electric-field radio waves according to the present invention.

As shown in the top view in FIG. 6(*a*), the loop antenna 13 in the Foregoing embodiment does not form a round shape with dents at the junction of the partial-loop antennas. The present embodiment, however, employs a round-shaped loop without any dents for the loop antenna 13, including the partial-loop antennas. In Fact, the shape of the loop antenna 13 does not really matter as long as the junction of the partial-loop antennas is made of a Flexible conductor which allows the lid 18 to bend.

Figure 7A:
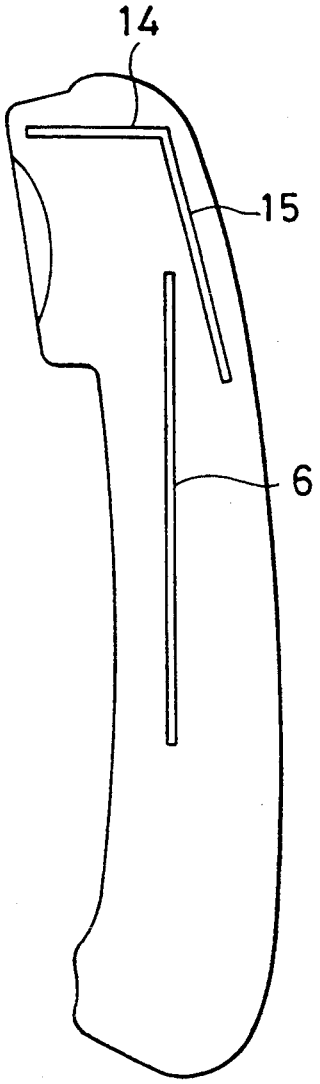
FIGS. 7(*a*) and 7(*b*) show a cross sectional view and an explanatory drawing of a portable radiotelephone illustrating an antenna configuration and a feeding method respectively according to another embodiment of the present invention.
Figure 7B:
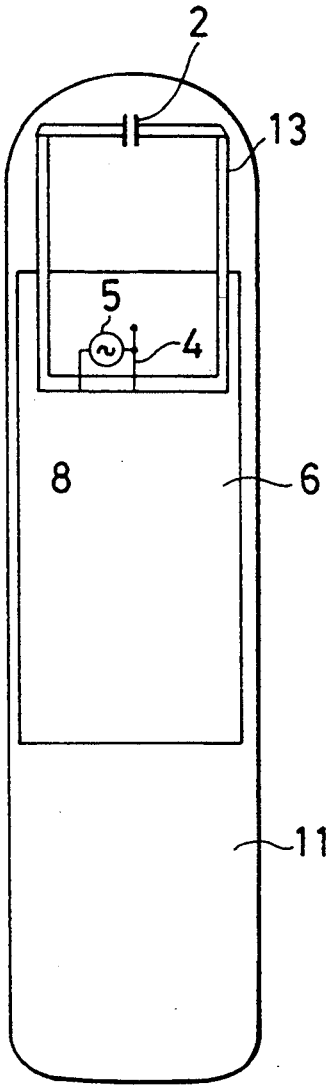

FIGS. 7(*a*) and 7(*b*) show a cross sectional view and an explanatory drawing of a portable radiotelephone illustrating an antenna configuration and a feeding method, respectively, according to another embodiment of the present invention. The numerals in the figure are same as those in the conventional design and other foregoing embodiments of the invention.

As shown in FIG. 7(*a*), the loop antenna 13 can be consisted of the first partial-loop antenna 14 vertically fixed to the user and the second partial-loop antenna 15 almost vertically fixed to the first partial-loop antenna 14 at the upper part of the main housing 11.

One of other possible loop-oriented antenna configurations is to provide another or a third partial-loop antenna at the bottom plane of the main housing 11 in FIG. 7(*a*) to be a three-partial-loop antenna configuration.

Figure 8A:
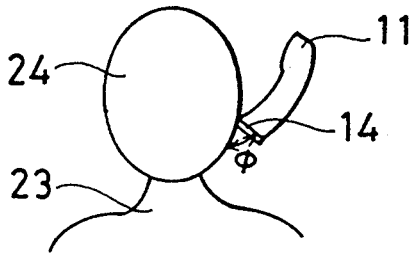
FIG. 8(*a*) illustrates the positioning angle "$\phi$" made by the first partial-loop antenna 14 within the bottom plane of a portable radiotelephone with the user 23 or the user's head 24 in telephone operating position.
Figure 8B:
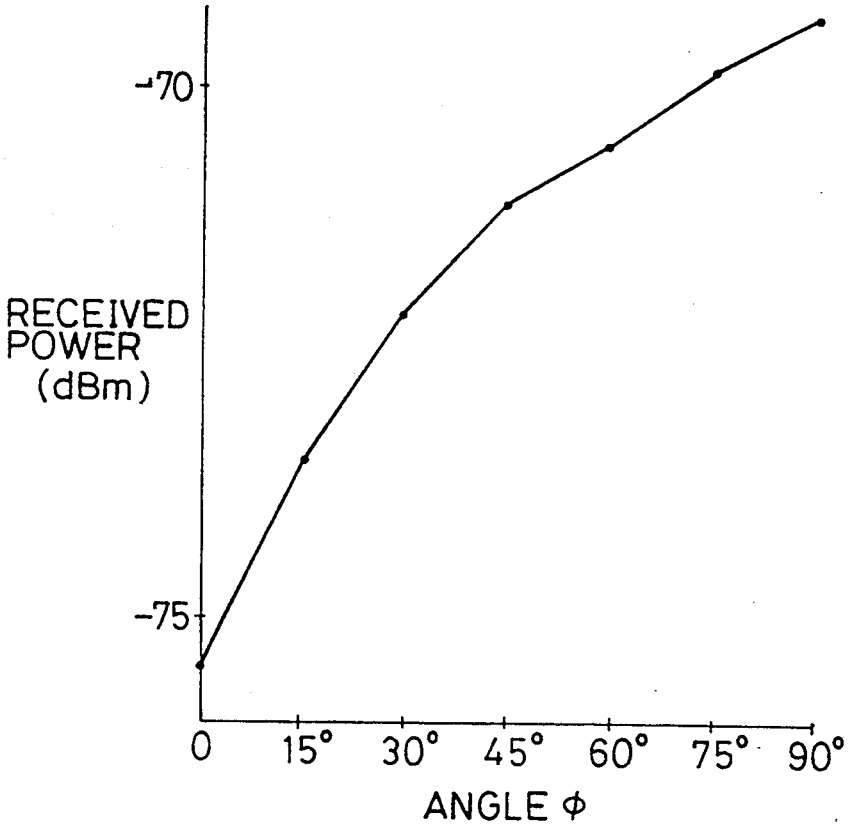

FIG. 8(*a*) illustrates "$\phi$", an angle made by the first partial-loop antenna 14 within the bottom plane of a portable radiotelephone with the user 23 or the user's head 24 in the telephone operating position. FIG. 8(*b*) is a graph of received power versus "$\phi$" or positioning angle.

In FIG. 8(*b*), the received power is the strongest when "$\phi$" is 90 degrees, or when the first partial-loop antenna 14 is normal to the head 24 of the user 23. The received power is becoming weaker as "$\phi$" becomes narrower toward zero degree or when the first partial-loop antenna 14 is parallel to the user 23.

This shows that the first partial-loop antenna 14 receives the highest power when the antenna 14 is normal to the user 23, or in other words, a portable radiotelephone is parallel to the user.

The foregoing discussions of the present invention show that, for an antenna which is dedicated to a portable radiotelephone, It is essential to consider the antenna-user relation and the telephone operating positions or/and angles in order to improve antenna performance in terms of received gain and directivity. In this respect, a multi-directional antenna configuration, including two or more planes of antenna in different directions, is ideal for receiving electromagnetic wave at various angles or directions. In other words, the antenna should be configurated in consideration of the nature of electromagnetic wave and of the antenna-user relation, dealing with at least two different cases in order to achieve satisfactory reception by a portable radiotelephone. Specifically, when an antenna is relatively close to the user or a virtual ground, it should be normal to the user and when relatively far from it within $\lambda/4$ on the other hand, it should be parallel to the user.

The foregoing embodiments have focussed on loop-oriented antenna configurations. The present invention, however, is not limited to loop-oriented antennas as requiring a solution to the foregoing problems of highly efficient antenna for sophisticated small-sized portable radiotelephones. Inverted-F-antennas or dipole antennas can also be employed instead of loop antennas in accordance with the present invention as long as the foregoing teachings are incorporated.

Further, the present invention is not be limited only to receiving magnetic-field waves, but also applies to radiation.

What is claimed is:

1. A loop antenna disposed substantially within a housing of a personal communications device and oriented with respect to a virtual ground plane, comprising:

a first partial-loop antenna having a plurality of ends, the first partial-loop antenna having a directivity which is oriented to substantially cross said virtual ground plane;

a second partial-loop antenna having a plurality of ends, a directivity of said second partial-loop antenna being oriented in a direction different from that of said first partial loop antenna; and a plurality of conductors for connecting said plurality of ends of said first and second partial-loop antennas;

wherein at least one of said first and second partial-loop antennas is symmetric about an axis, said loop antenna further comprising a microphone disposed along said axis substantially in a center of said at least one symmetric partial-loop antenna.

2. A loop antenna disposed substantially within a housing of a personal communications device and oriented with respect to a virtual ground plane, comprising:

a first partial-loop antenna having a plurality of ends, the first partial-loop antenna having a directivity which is oriented to substantially cross said virtual ground plane;

a second partial-loop antenna having a plurality of ends, a directivity of said second partial-loop antenna being oriented in a direction different from that of said first partial loop antenna; and a plurality of conductors for connecting said plurality of ends of said first and second partial-loop antennas;

wherein at least one of said first and second partial-loop antennas is symmetric about an axis of symmetry, said antenna further comprising a matching capacitor disposed along said axis of symmetry within the at least one symmetric partial-loop antenna.

3. A loop antenna disposed substantially within a housing of a personal communications device and oriented with respect to a virtual ground plane, comprising:

a first partial-loop antenna having a plurality of ends, the first partial-loop antenna having a directivity which is oriented to substantially cross said virtual ground plane;

a second partial-loop antenna having a plurality of ends, a directivity of said second partial-loop antenna being oriented in a direction different from that of said first partial loop antenna; and a plurality of conductors for connecting said plurality of ends of said first and second partial-loop antennas;

wherein at least the second partial-loop antenna is symmetrically disposed about an axis of symmetry and includes at least two matching capacitors symmetrically disposed about the axis of symmetry.

* * * * *